US006450179B2

(12) United States Patent
Bengis

(10) Patent No.: US 6,450,179 B2
(45) Date of Patent: Sep. 17, 2002

(54) COSMETIC CONTAINER WITH INTERCHANGEABLE ATTACHMENTS

(75) Inventor: John Joseph Bengis, White Plains, NY (US)

(73) Assignee: John J. Bengis, White Plains, NY (US)

( * ) Notice: Subject to any disclaimer, the term of this patent is extended or adjusted under 35 U.S.C. 154(b) by 0 days.

(21) Appl. No.: 09/917,931

(22) Filed: Jul. 27, 2001

Related U.S. Application Data

(60) Provisional application No. 60/221,713, filed on Jul. 31, 2000.

(51) Int. Cl.[7] ..... A45D 34/04; A45D 34/06

(52) U.S. Cl. ..... 132/297; 132/73.5; 132/318; 401/18; 401/19; 401/52

(58) Field of Search ..... 132/294, 297, 132/314, 317, 318, 73, 73.5, 74.5; 401/18, 19, 29, 52, 122

(56) References Cited

U.S. PATENT DOCUMENTS

| | | | | | |
|---|---|---|---|---|---|
| 1,655,452 | A | | 1/1928 | Ament | |
| 1,749,565 | A | | 3/1930 | Coryell | |
| 2,528,612 | A | * | 11/1950 | Schildkraut et al. | 132/314 |
| 2,610,733 | A | | 9/1952 | Balasevich | |
| 2,665,696 | A | * | 1/1954 | Weis | 132/318 |
| 2,687,133 | A | | 8/1954 | Schwarz et al. | |
| 2,804,082 | A | | 8/1957 | Dewing | |
| 2,813,289 | A | * | 11/1957 | Even | 132/318 |
| 3,130,433 | A | * | 4/1964 | John | 132/317 |
| 3,818,627 | A | * | 6/1974 | Lebensfeld | |
| D254,151 | S | | 2/1980 | Wolff | |
| D260,559 | S | | 9/1981 | Scalice | |
| 4,888,667 | A | | 12/1989 | Hwang | |
| 5,178,478 | A | | 1/1993 | Ryder | |
| D342,021 | S | | 12/1993 | Porta | |
| 5,373,940 | A | | 12/1994 | Hillelson | |
| D354,373 | S | | 1/1995 | Khoury | |
| D376,910 | S | | 12/1996 | Tuchman | |
| 5,715,848 | A | * | 2/1998 | Conley, Jr. | 132/297 |
| D405,555 | S | | 2/1999 | De Melo et al. | |
| 5,909,740 | A | | 6/1999 | Sussman | |
| 5,941,254 | A | * | 8/1999 | Heler | 132/297 |
| 6,200,045 | B1 | * | 3/2001 | Hahn et al. | 401/18 |
| 6,241,408 | B1 | * | 6/2001 | Lang | 132/297 |
| 6,276,853 | B1 | * | 8/2001 | Breidenbach et al. | 401/18 |

* cited by examiner

*Primary Examiner*—Todd E. Manahan
(74) *Attorney, Agent, or Firm*—Kramer Levin Naftalis & Frankel LLP

(57) ABSTRACT

A cosmetic container includes a lipstick compartment having a distal end adapted to removably engage one of a set of interchangeable attachments, such as a receptacle for a second cosmetic and applicator, a cosmetic pencil sharpener, or a receptacle for holding an aqueous bubble forming solution and an appropriate bubble blowing device. An attachment mechanism is provided at the distal end to engage/disengage a given attachment. The attachment mechanism has an outer surface provided with splines or the like for grippingly engaging an inner surface of the distal end of the lipstick compartment to achieve a friction-fit connection that resists undesirable rotational movement within the container.

33 Claims, 4 Drawing Sheets

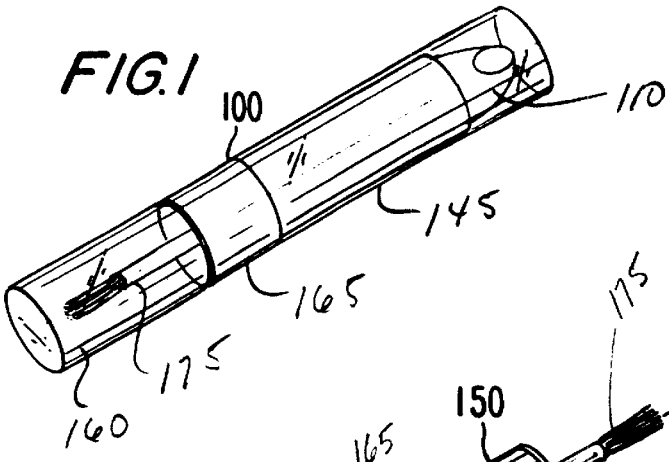
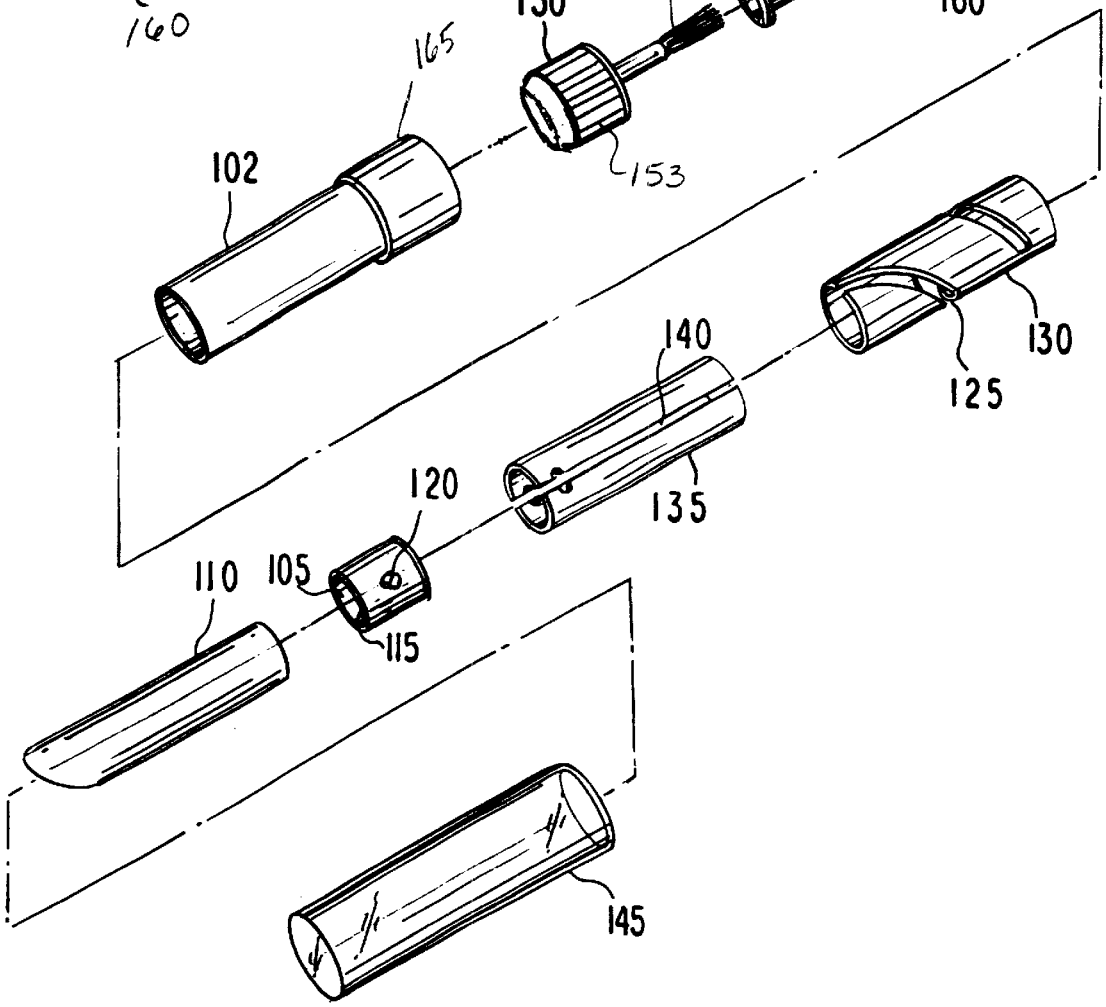
FIG.2

COSMETIC CONTAINER WITH INTERCHANGEABLE ATTACHMENTS

CROSS REFERENCE TO RELATED PROVISIONAL APPLICATION

This application claims the benefit of U.S. Provisional Patent Application No. 60/221,713 filed on Jul. 31, 2000.

BACKGROUND OF THE INVENTION

The present invention is generally related to the field of cosmetic containers, such as lipstick dispensers. In particular, the present invention relates to a lipstick dispenser adapted to accept a variety of interchangeable attachments, such as, for example, a receptacle for a second cosmetic product, an appropriate cosmetic applicator, a cosmetic pencil sharpener or a receptacle for an aqueous bubble solution and bubble blowing device.

Conventionally, certain cosmetic products such as lipstick are held alone in a metal or plastic tube provided with a mechanism to raise or lower the lipstick out of one end of the tube, usually for direct application. While it is generally known to provide a lipstick dispenser in combination with a container or dispenser of another product, the present invention has been developed to improve over such prior art containers by providing a lipstick dispenser that may mate with one of a variety of interchangeable attachments.

SUMMARY OF THE INVENTION

Generally, in accordance with the present invention, a cosmetic container, preferably a lipstick dispenser, having a base portion adapted to accept one of a set of various interchangeable attachments is provided. The cosmetic container according to the present invention uniquely meets the needs of cosmetic users by permitting them to reduce the number of separate containers they carry, while, at the same time, permitting a dynamic range of choices as to the combinations of products they carry.

In a preferred embodiment, the inventive cosmetic container is a lipstick dispenser arranged and constructed to removably couple with a receptacle for holding an additional cosmetic product, such as, for example, nail polish, and an appropriate application device, such as, for example, a brush, to form a single container having multiple cosmetic uses. In an alternative embodiment, the lipstick dispenser is adapted to removably couple with a cosmetic pencil sharpener. In further alternative embodiments, the lipstick dispenser is adapted to removably engage a perfume roll-on applicator or a perfume atomizer. In a still further embodiment, the lipstick dispenser is adapted to removably couple with a receptacle for holding an aqueous bubble forming solution and an appropriate bubble blowing wand for entertaining children of all ages.

Preferably, in all embodiments of the cosmetic container according to the present invention, the interchangeable attachment for combination with the lipstick dispenser includes an engagement member having an outer surface provided with splines or the like arranged and constructed to grippingly engage an inner surface of an open end of the base of the lipstick dispenser to achieve a friction-fit connection that resists undesirable rotational movement.

In embodiments of the cosmetic container according to the present invention which feature removable receptacles for a separate cosmetic product or other material, the open end or neck of each receptacle preferably includes a wiper with a seal or gasket and is threaded to engage a corresponding threaded portion on an end of the engagement member which also serves as a cap for the receptacle. This arrangement allows for the removal of excess cosmetic product as the applicator is drawn from the attached receptacle for use, and provides a substantially leak-proof seal while maintaining the often volatile internal contents of the receptacle against exposure to the external environment when not in use.

Accordingly, it is an object of the present invention to provide a cosmetic container with interchangeable attachments.

Another object of the present invention is to provide a dual purpose cosmetic container with enhanced features.

A still further object of the present invention is to provide an improved lipstick package with a secondary cosmetic attachment.

Yet another object of the present invention is to provide a cosmetic package having a first cosmetic application and a secondary device.

Still other objects and advantages of the invention will in part be obvious and will in part be apparent from the following detailed specification.

The invention accordingly comprises the features of construction, combination of elements, and arrangement of component parts all as exemplified in the following detailed disclosure, and the scope of the invention will be indicated in the claims.

BRIEF DESCRIPTION OF THE DRAWINGS

For a filler understanding of the invention, reference is had to the following description taken in connection with the accompanying drawings, in which:

FIG. 1 is a perspective view of a cosmetic container according to a preferred embodiment of the present invention.

FIG. 2 is an exploded view of the preferred embodiment of the cosmetic container according to the present invention depicted in FIG. 1.

DETAILED DESCRIPTION OF THE PREFERRED EMBODIMENTS

Figure 3B:
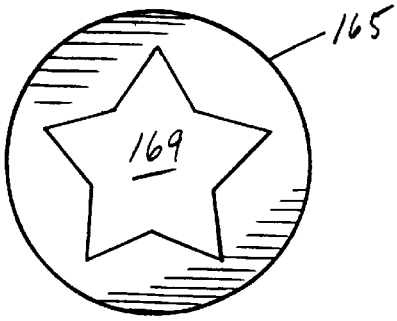
FIG. 3*b* is a top plan view of the open base of the lipstick compartment of an alternative embodiment of the container according to the present invention showing a star-shaped interior configuration.

In the drawings where like numerals indicate like elements, FIG. 1 shows a cosmetic container according to a preferred embodiment of the present invention which is generally designated by reference numeral 100. Container 100 is preferably formed or molded from a suitable plastic material or metal. Although container 100 shown in FIG. 1 has a preferred substantially cylindrical shape, it should be understood that the container is not limited to this particular shape.

Referring to FIG. 2, container 100 includes a lipstick compartment 102 which houses a seat 105 arranged and constructed to engage one end of a lipstick 110. Preferably, an inner wall 115 of seat 105 includes spaced apart protrusions or ribs (not shown) to grippingly engage lipstick 110 and hold the lipstick against rotational movement with respect to the seat.

Seat 105 includes a bottom portion preferably provided with a projection, key or follower 120 extending therefrom. Follower 120 is arranged and constructed for reception within a helical channel 125 of an elevator tube 130 also disposed within container 100.

An inner tubular sleeve 135 is provided in telescoping engagement with elevator tube 130. Sleeve 135 surrounds lipstick 110 and includes one or more vertical channels or keyways 140 to form a stop system as described below. Follower 120 engages keyways 140 as well as helical channel 125.

Upon rotation of elevator tube 130 within compartment 102, follower 120 rides along channel 125 and keyways 140 to direct seat 105 axially along tube 130 and sleeve 135 for extension of lipstick 110 for use. The length of keyways 140 in which follower 120 rides determines the longitudinal displacement of lipstick 110.

A tubular sheath 145 is provided to receive compartment 102 to close lipstick compartment 100. Sheath 145 is preferably transparent, but may also be tinted a variety of colors.

It should be understood that other arrangements for dispensing the lipstick, including without the use of keyways, may be utilized.

Compartment 102 is adapted to accommodate the insertion of one of a set of interchangeable attachments. FIGS. 1 and 2 depict a preferred embodiment of the inventive container 100 wherein a cosmetic receptacle 160 for holding a second cosmetic product is provided for interchangeable engagement with the base 165 of the lipstick compartment 102. Receptacle 160 may be formed from any suitable material such as glass or plastic.

Referring to FIG. 2, receptacle 160 includes an open neck 170 to provide access to the contents of the receptacle and to receive a cap 150 which also serves as a mechanical attachment to removably couple the receptacle to base 165 of lipstick compartment 102 as described in greater detail hereinafter. The interior of cap 150 preferably supports an applicator such as a nail polish brush 175 projecting therefrom.

Desirably, cap 150 may be manipulated so that receptacle 160 may be removed from lipstick compartment 102 for attachment to a different lipstick compartment or for separate independent use. Accordingly, cap 150 is adapted to friction fit with compartment 102 to permit easy and consistent removal and replacement of receptacle 160 when desired.

Figure 3C:
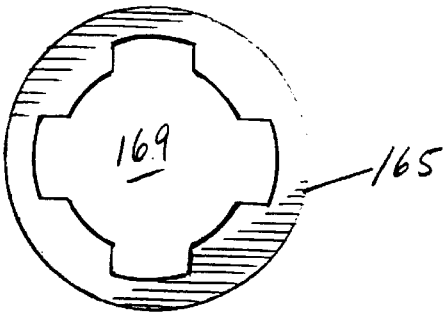
FIG. 3*c* is a top plan view of the open base of the lipstick compartment of an alternative embodiment of the container according to the present invention showing another alternative interior configuration.
Figure 3A:
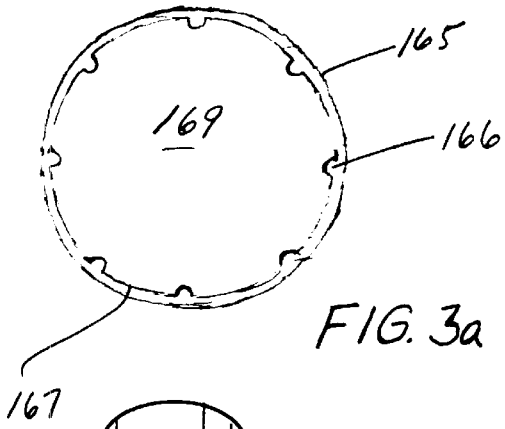
FIG. 3*a* is a top plan view of the open base of the lipstick compartment of the container according to a preferred embodiment of the present invention showing a cylindrical interior configuration having ribs.

Preferably, the outer surface of cap 150 is provided with splines 153 for grippingly engaging ribs 166 provided on the inner annular surface 167 of the open end 169 of base 165 of lipstick compartment 102. As shown in FIG. 3*a*, ribs 166 on inner surface 167 of base 165 resist undesirable rotational movement of cap 150 within the base.

FIG. 3*a* depicts a preferred arrangement for open end 169 of base 165. The alternative configurations for open end 169 of base 165 depicted in FIGS. 3*b* and 3*c*, for example, may also be utilized.

FIGS. 1 and 2 show lipstick compartment 102 removably coupled to cap 150 provided with nail polish brush applicator 175 and nail polish receptacle 160 to make the nail polish and lipstick compartment one unit with multiple uses. In the inventive container depicted in FIGS. 1 and 2, neck 170 of receptacle 160 is also preferably provided with an insertable wiper with a seal or gasket 155. It should be appreciated that this arrangement allows for the removal of excess cosmetic product as brush 175 is drawn from receptacle 160 when the inventive container is in use, and provides a substantially leak-proof seal while maintaining the often volatile internal contents of the attached receptacle against exposure to the external environment when not in use.

When application of a cosmetic in the attachable receptacle 160 is desired, the user preferably grasps lipstick compartment 102 and the receptacle and detaches the receptacle from cap 150 which remains coupled to the lipstick compartment. This provides the user with separate access to applicator 175, if one is used in the application, and to the receptacle contents. The user then applies the cosmetic (in the case of nail polish, using brush 175 to apply the polish). After use, receptacle 160 is screwed back into cap 150.

When application of the lipstick is desired, the user slides off sheath 145 of lipstick compartment 102, extends and applies lipstick 110, retracts the lipstick after use, and then slides the sheath back into place on the lipstick compartment.

It should be understood that it may not be necessary or desirable to provide an applicator in certain embodiments of the inventive cosmetic container, for example, if the product contained in receptacle 160 is a cream that is applied by hand such as sun screen or the like.

Figure 4A:
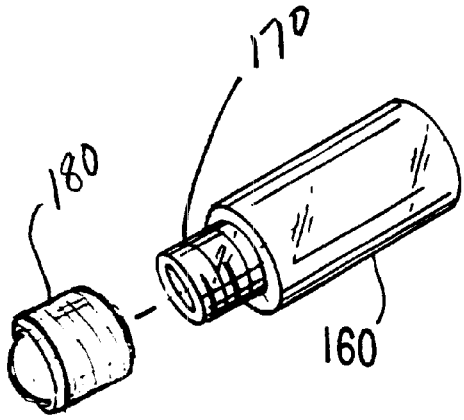
FIG. 4*a* is an exploded view of a perfume receptacle and roll-on applicator attachment for the cosmetic container according to an alternative embodiment of the present invention.
Figure 4B:
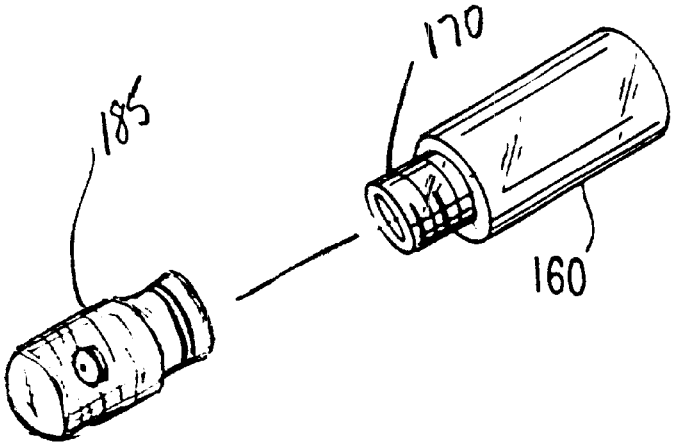
FIG. 4*b* is an exploded view of a perfume receptacle and atomizer attachment for the cosmetic container according to an alternative embodiment of the present invention.

In alternative embodiments of the inventive cosmetic container 100 wherein receptacle 160 contains perfume, means for dispensing the perfume are preferably provided as an attachment to receptacle neck 170 and not supported by cap 150. FIG. 4*a* depicts a perfume roll-on applicator attachment 180 for receptacle neck 170. Roll-on applicator 180 threadably engages neck 170 and is preferably provided with external threads for threadably engaging cap 150. FIG. 4*b* depicts a perfume atomizer attachment 185 for receptacle neck 170. Atomizer 185 threadably engages neck 170 and is preferably provided with external threads for threadably engaging cap 150.

It should be appreciated that the inventive lipstick compartment is preferably longer and slightly heavier than that of a conventional lipstick compartment. The sheath for the lipstick compartment is also preferably longer and slightly heavier than a standard applicator cover. The applicator for the receptacle attachment will have the lipstick compartment as its applicator base and the lipstick will have the receptacle as its applicator base. The larger size of the lipstick compartment has the salutary ergonomic benefit of affording the user greater stability in the application of the cosmetic product because it is easier to manipulate.

Figure 5:
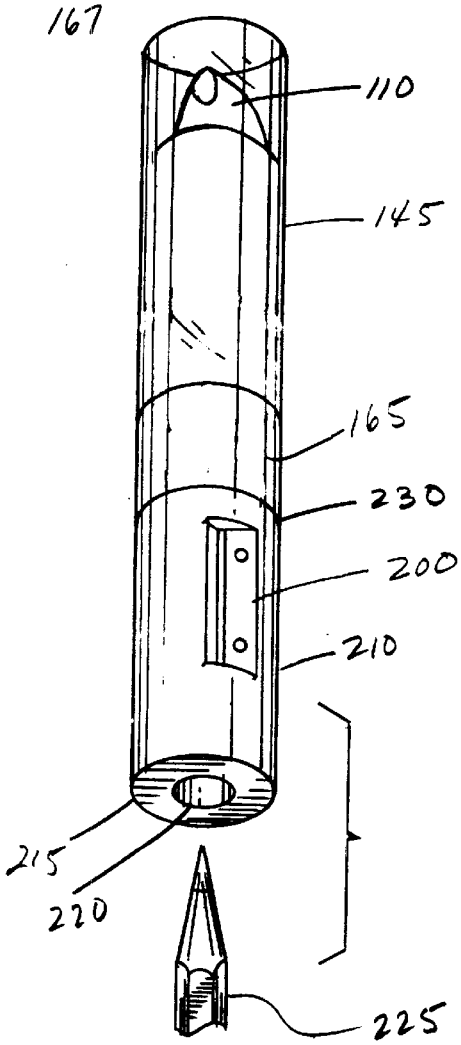
FIG. 5 depicts an alternative embodiment of the cosmetic container according to the present invention adapted to engage a cosmetic pencil sharpener attachment.

FIG. 5 shows an alternative embodiment of container 100 according to the present invention wherein a cosmetic pencil sharpener 200 is provided for interchangeable engagement with base 165 of lipstick compartment 102. It should be appreciated that the combination of lipstick compartment 102 and pencil sharpener 200 forms an alternative convenient dual-purpose cosmetic package.

The use of lip liner pencils typically goes hand-in-hand with regular lipstick use. These pencils require frequent sharpening, so the partnership of lipstick dispenser and sharpener is desirable. Sharpeners are also used for lipstick and other cosmetic pencils such as eyeliner and eyebrow pencils. Present day cosmetic sharpeners are provided as separate devices and are often small and easy to misplace. The integration of the lipstick case and sharpener offers users the salutary benefit of having what they need, where they need it.

Sharpener attachment 200 may be formed from any suitable material such as metal or plastic. Sharpener 200 is preferably housed within a shavings capture container or barrel 210 formed from glass, plastic or like material. Barrel 210 may be provided in various suitable sizes. Base 215 of barrel 210 is provided with an entrance hole 220 for inserting and sharpening cosmetic pencil 225 or lipstick 110. The opposing end of barrel 210 has an open neck 230 adapted to threadably engage cap 150 (not shown in FIG. 5) for removably coupling the barrel and lipstick compartment 102 in a manner such as described above in connection with the preferred embodiment of the cosmetic container according to the present invention (best depicted in FIG. 2).

As with the preferred embodiment discussed above and best shown in FIG. 2, cap 150 preferably has an outer surface provided with splines 153 or the like for grippingly engaging the inner surface of open end 169 of base 165 of lipstick compartment 102. The inner surface of base 165 of lipstick compartment 102 preferably includes ribs 166 to resist undesirable rotational movement of cap 150 within the base.

Barrel 210 may be emptied by detaching it completely from cap 150. Alternatively, a slide cover (not shown) may be provided on sharpener barrel 210 to permit easy emptying of the contents of the barrel. This is accomplished by sliding the cover into an open position, and then sliding it back into a normally closed position.

When cosmetic pencil or lipstick sharpening is required, the user grasps lipstick compartment 102, places pencil 225 or lipstick 110 in sharpener 200 and turns the pencil or lipstick until desired sharpness is attained. After multiple uses and when convenient, shavings barrel 210 may be emptied as described above.

When application of the lipstick is desired, the user will encounter at least the same ease of use found in traditional packaging. The user slides off sheath 145 of lipstick compartment 102, extends lipstick 110 for use, retracts the lipstick after use, and replaces the sheath on the lipstick compartment.

Sharpener attachment 200 is preferably longer and slightly heavier than a conventional stand-alone cosmetic sharpener. As lipstick compartment 102 uses sharpener attachment 200 as its base, the increased size of the sharpener attachment offers the salutary ergonomic benefit of affording the user greater stability in the application of the lipstick because it is easier to manipulate.

Figure 6:
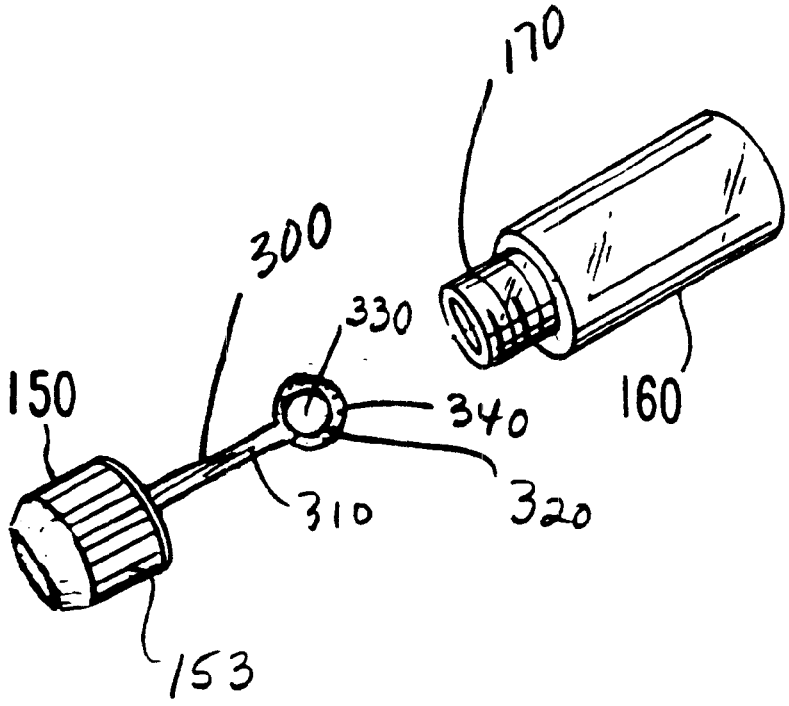
FIG. 6 depicts an alternative embodiment of the cosmetic container according to the present invention adapted to engage a receptacle for holding an aqueous bubble solution and wand bubble blowing device.

FIG. 6 depicts another embodiment of the cosmetic container 100 according to the present invention wherein receptacle 160 holds a bubble forming aqueous solution for interchangeable engagement with base 165 of lipstick compartment 102. Receptacle 160 may be formed from any suitable material such as glass or plastic.

Receptacle 160 includes open neck 170 to provide access to the contents of the receptacle and to receive cap 150 which also serves as a mechanical attachment to removably couple the receptacle to base 102. The interior of cap 150 preferably supports a bubble blowing implement 300 projecting therefrom.

A suitable conventional implement 300 for holding aqueous bubble solutions is a wand as shown in FIG. 6. Wand 300 typically includes a handle 310 with a loop 320 formed at the distal end for holding the bubble solution. Opening 330 formed by loop 320 typically has ridges 340 to which the solution may bridge. Ridges 340 maintain the solution in a fixed position forming a thin film across opening 330.

As with the preferred embodiment discussed above and best shown in FIG. 2, cap 150 preferably has an outer surface provided with splines 153 or the like for grippingly engaging the inner surface of open end 169 of base 165 of lipstick compartment 102. The inner surface of base 165 of lipstick compartment 102 preferably includes ribs 166 to resist undesirable rotational movement of cap 150 within the base. Additionally, neck 170 of receptacle 160 is preferably provided with an appropriate seal or gasket 155 to prevent leaking of the solution when the bubble blowing attachment is not in use.

In operation, the user grasps lipstick compartment 102 and receptacle 160 and detaches the receptacle from cap 150 which remains coupled to the lipstick compartment. This provides the user with separate access to wand 300 and to the bubble solution in receptacle 160. The user then may immerse wand 300 in the solution so that a thin film of solution is formed across wand opening 330. The user then directs air through opening 330 to fill the middle of the film and force the aqueous solution free of ridges 340 and into a bubble. After use, receptacle 160 is screwed back into cap 150.

When application of lipstick 110 is desired, the user slides off sheath 145 of lipstick compartment 102, extends and applies the lipstick, retracts the lipstick after use, and then slides the sheath back into place on the lipstick compartment.

It will thus be seen that the objects set forth above, among those made apparent from the preceding description, are efficiently attained and, since certain changes may be made in the above constructions without departing from the spirit and scope of the invention, it is intended that all matter contained in the above description and depicted in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A multi-purpose container, comprising a compartment for housing a first product, said compartment including a dispenser for dispensing said first product and an open base, said open base including an interior surface having a plurality of ribs projecting therefrom, a cap having an outer surface including a plurality of corresponding splines for engaging said ribs to releasably couple said cap to said compartment and resist rotational movement of said cap within said base, and a receptacle for holding a second product, said receptacle having an open neck adapted to releasably engage said cap.

2. A multi-purpose container according to claim 1, wherein said cap supports an applicator for removable insertion in said receptacle.

3. A multi-purpose container according to claim 1, further comprising a first product in said compartment.

4. A multi-purpose container according to claim 3, wherein said first product is a cosmetic.

5. A multi-purpose container according to claim 4, wherein said cosmetic is lipstick.

6. A multi-purpose container according to claim 1, further comprising a cover for said compartment.

7. A multi-purpose container according to claim 1, further comprising a wiper gasket adapted for insertion in said open neck of said receptacle.

8. A multi-purpose container according to claim 1, further comprising a second product in said receptacle.

9. A multi-purpose container according to claim 8, wherein said second product is nail polish.

10. A multi-purpose container according to claim 9, wherein said cap supports a brush for removable insertion in said receptacle.

11. A multi-purpose container according to claim 8, wherein said second product is perfume.

12. A multi-purpose container according to claim 11, further comprising a roller applicator adapted to removably engage said open neck of said receptacle and said cap.

13. A multi-purpose container according to claim 11, further comprising an atomizer applicator adapted to removably engage said open neck of said receptacle and said cap.

14. A multi-purpose container according to claim 8, wherein said second product is an aqueous bubble forming solution.

15. A multi-purpose container according to claim 14, wherein said cap supports a bubble blowing device for removable insertion in said receptacle.

16. A multi-purpose container, comprising a compartment for housing a first product, said compartment including a dispenser for dispensing said first product and an open base, a cap having an outer surface adapted to be releasably engaged in said open base, a receptacle, said receptacle having an open neck adapted to releasably engage said cap and an opposing end, a sharpener housed within said receptacle, said opposing end of said receptacle defining an opening for passing an implement for sharpening to said sharpener.

17. A multi-purpose container according to claim 16, wherein said implement is a cosmetic pencil.

18. A multi-purpose container according to claim 16, wherein said first product is a cosmetic.

19. A multi-purpose cosmetic container, comprising a compartment for housing a first cosmetic product, said compartment including a dispenser for dispensing said first cosmetic product and an open base, a cap having an outer surface, said open base including an interior surface, said outer surface of said cap and said interior surface of said base shaped to permit removable coupling of said cap with said compartment while resisting rotational movement of said cap within said base; a receptacle for holding a second product, said receptacle having an open neck adapted to releasably engage said cap, and a second product applicator supported on at least one of said cap and said open neck.

20. A multi-purpose container according to claim 19, wherein said first cosmetic product is lipstick.

21. A multi-purpose container, comprising a compartment for housing a first product, said compartment including a dispenser for dispensing said first product and an open base, said open base including an interior surface having a preselected shape, a cap having an outer surface having a shape corresponding to said preselected shape of said interior surface of said open base for releasably coupling said cap to said compartment while resisting rotational movement of said cap within said base, and a receptacle for holding a second product, said receptacle having an open neck adapted to releasably engage said cap.

22. A multi-purpose container according to claim 21, further comprising a cover for said compartment.

23. A multi-purpose container according to claim 21, further comprising a first product in said compartment.

24. A multi-purpose container according to claim 23, wherein said first product is a cosmetic.

25. A multi-purpose container according to claim 24, wherein said cosmetic is lipstick.

26. A multi-purpose container according to claim 21, further comprising a second product in said receptacle.

27. A multi-purpose container according to claim 26, wherein said second product is nail polish.

28. A multi-purpose container according to claim 27, wherein said cap supports a brush for removable insertion in said receptacle.

29. A multi-purpose container according to claim 26, wherein said second product is perfume.

30. A multi-purpose container according to claim 29, further comprising an atomizer applicator adapted to removably engage said open neck of said receptacle and said cap.

31. A multi-purpose container according to claim 29, further comprising a roller applicator adapted to removably engage said open neck of said receptacle and said cap.

32. A multi-purpose container according to claim 26, wherein said second product is an aqueous bubble forming solution.

33. A multi-purpose container according to claim 32, wherein said cap supports a bubble blowing device for removable insertion in said receptacle.

* * * * *